US005918091A

United States Patent [19]

Saeki

[11] Patent Number: 5,918,091

[45] Date of Patent: Jun. 29, 1999

[54] ENDLESS PHOTORECEPTOR BELT FOR USE IN A RECORDING DEVICE

[75] Inventor: Tomoya Saeki, Niigata, Japan

[73] Assignee: NEC Corporation, Japan

[21] Appl. No.: 09/065,851

[22] Filed: Apr. 24, 1998

[30] Foreign Application Priority Data

Apr. 25, 1997 [JP] Japan ..... 9-109832

[51] Int. Cl.[6] ..... G03G 15/00

[52] U.S. Cl. ..... 399/162; 399/116

[58] Field of Search ..... 399/107, 110, 399/116, 159, 162, 26; 430/32, 56, 127, 132

[56] References Cited

U.S. PATENT DOCUMENTS

| | | | |
|---|---|---|---|
| 3,619,050 | 11/1971 | Swanke . | |
| 5,386,273 | 1/1995 | Wood et al. | 399/116 |
| 5,400,121 | 3/1995 | Foote | 399/116 |
| 5,417,322 | 5/1995 | Jeran et al. | 399/116 X |
| 5,532,797 | 7/1996 | Arcaro | 399/162 |
| 5,541,709 | 7/1996 | Wilcox | 399/116 |
| 5,708,924 | 1/1998 | Shogren et al. | 399/116 |

FOREIGN PATENT DOCUMENTS

| | | |
|---|---|---|
| 655659 | 5/1995 | European Pat. Off. . |
| 60-136784 | 7/1985 | Japan . |
| 64-74573 | 3/1989 | Japan . |
| 64-74578 | 3/1989 | Japan . |
| 157344 | 12/1989 | Japan . |
| 3-191364 | 8/1991 | Japan . |
| 4247468 | 9/1992 | Japan . |

OTHER PUBLICATIONS

Patent Abstracts of Japan, vol. 010, No. 149, May 30, 1986–JP 61–003185, Jan. 9, 1986.

Patent Abstracts of Japan, vol. 018, No. 376, Jul. 14, 1994–JP 6–102714, Apr. 15, 1994.

Patent Abstracts of Japan, vol. 010, No. 334, Nov. 13, 1986–JP 61–138281, Jun. 25, 1986.

Patent Abstracts of Japan, vol. 009, No. 265, Oct. 23, 1985–JP 60 114893, Jun. 21, 1985.

*Primary Examiner*—Sandra Brase

*Attorney, Agent, or Firm*—Ostrolenk, Faber, Gerb & Soffen, LLP

[57] ABSTRACT

A photoreceptor belt for use in a recording device using a electrophotographic technique comprises a lead tape having a free tip and a trailing edge attached to a protective film covering a photoreceptor layer formed on an endless belt base. When a new photoreceptor belt is installed in a recording device, the tip of the lead tape and the following protective film is removed from the photoreceptor belt by a lead tape guide, thereby avoiding a damage of the photoreceptor layer by the operator.

9 Claims, 3 Drawing Sheets

ENDLESS PHOTORECEPTOR BELT FOR USE IN A RECORDING DEVICE

BACKGROUND OF THE INVENTION (a) Field of the Invention

The present invention relates to an endless photoreceptor belt for use in a recording device using an electrophotographic technique such as a printer, facsimile and copying machine. The present invention also relates to a recording device using such an endless photoreceptor belt.

(b) Description of the Related Art

In a recording device such as printer, facsimile and copying machine using an electrophotographic technique, a photoreceptor layer for forming a latent image is supported by a mechanical carrier such as a drum having an aluminum tube as a base material, or an endless belt having a resin film base.

In the recording devices as recited above, the photoreceptor layer is first exposed to light by using an erasing lamp to remove all the electric charge formed by the previous steps and remaining on the photoreceptor layer, followed by provision with uniform electric charge by using corona discharge or charge roll. Subsequently, light from a semiconductor laser (LD) or a light emitting diode (LED) is irradiated onto the photoreceptor layer to generate a charge distribution profile on the photoreceptor layer based on the image data supplied to the recording device. The toner supplied onto the surface of the photoreceptor layer is attracted onto the electric charge on the photoreceptor layer for toner development. The toner attracted onto the photoreceptor layer is then transferred to a recording sheet directly or indirectly, i.e., through an intermediate transferring medium, to form an image based on the image data.

In the recording device using the electrophotographic technique, a photoreceptor layer is iteratively subjected to an electrical or thermal stress by the imaging operation and eventually degraded thereby. As a result, the photoreceptor drum or belt is regularly replaced at a suitable period of time. A new photoreceptor belt, for example, stored for this purpose has a protective film for protecting the photoreceptor layer against a damage such as scratch or optical fatigue (degradation) during the storage.

In a conventional photoreceptor belt, when the operator removes the protective film from the photoreceptor belt, the surface of the photoreceptor layer is sometimes damaged by scratch inadvertently generated by the operator or optical fatigue. Even if the surface of the photoreceptor layer has only a small damage, the quality of the resultant image is degraded significantly. It is therefore important to prevent the damage occurring on the photoreceptor layer during the removal of the protective film, as well as protecting the photoreceptor layer during the storage of the photoreceptor belt against dust or external light such as from sun or room illumination.

Patent Publication JP-A-64(1989)-74573 or JP-A-64-74578 proposes a cartridge type photoreceptor belt, which has a cartridge for receiving a photoreceptor belt therein and is replaced together with the photoreceptor belt in a recording device. This is effective for the operator to replace the photoreceptor with ease. However, the cartridge discarded in each replacement raises the cost of the photoreceptor belt and involves an environmental problem.

SUMMARY OF THE INVENTION

It is an object of the present invention to provide a new photoreceptor belt which is protected against a damage during storage and replacement thereof and can be manufactured at a relatively low cost.

The present invention provides a photoreceptor belt comprising an endless belt, a photoreceptor layer formed on an outer surface of the endless belt, and a protective film covering the photoreceptor layer and having a leading edge portion overlying a trailing edge and attached thereto, and an extension extending from the leading edge portion of the protective film, the extension having a higher stiffness than the protective film.

The present invention also provides a recording device comprising a set of rollers for driving a photoreceptor belt having a photoreceptor layer and a protective film covering the photoreceptor layer and having an extension extending therefrom, a charge unit for electrifying the photoreceptor layer, an exposure unit for exposing the photoreceptor layer for generating a charge distribution profile, a development unit for developing the photoreceptor layer to have a toner image, a transfer unit for transferring the toner image onto a recording medium, a lead tape guide, disposed in association with one of the rollers, for guiding a tip of the extension to remove the extension and the protective film from the photoreceptor layer.

In accordance with the photoreceptor belt or the recording device of the present invention, the protective layer can be removed from the photoreceptor belt to expose the photoreceptor layer without assistance by an operator, and without using a cartridge which raises the cost of the photoreceptor belt.

The above and other objects, features and advantages of the present invention will be more apparent from the following description, referring to the accompanying drawings.

PREFERRED EMBODIMENTS OF THE INVENTION

Figure 1A:
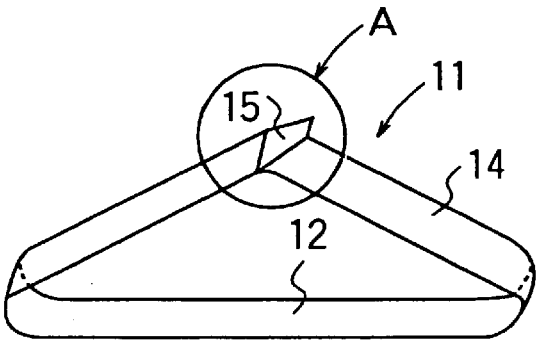
FIGS. 1A and 1B are perspective views of a photoreceptor belt according to a first embodiment of the present invention in a normal state and a state of removal of a protective film.

Now, the present invention is more specifically described with reference to accompanying drawings, wherein similar constituent elements are designated by the same or similar reference numerals.

Figure 2:
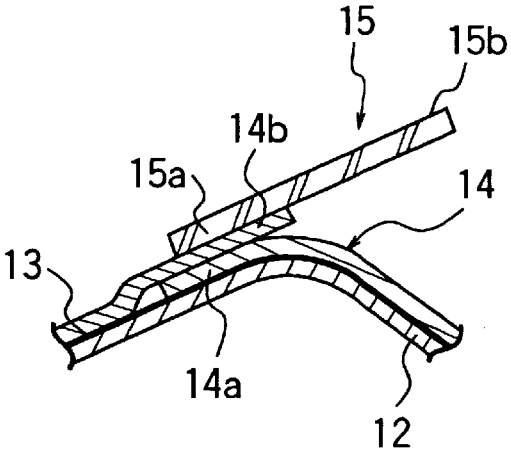
FIG. 2 is a cross-sectional view of a portion "A" of the photoreceptor belt of the first embodiment.

Referring first to FIG. 1A, there is shown a normal state of a photoreceptor belt according to a first embodiment of the present invention just after it is installed in a recording device. The photoreceptor belt generally designated by 10 has an endless belt portion 11 and an extension 15 extending from the endless belt portion 11. Referring additionally to FIG. 2, the photoreceptor belt 10 comprises an endless base belt 12, a photoreceptor layer 13 formed on the outer surface of the base belt 12, a protective film 14 covering the photoreceptor layer 13, and a lead tape forming the extension 15 of the protective film 14. A leading edge portion 14*b* of the protective film 14 as viewed along the moving direction of the photoreceptor belt 10 overlies and attached to a trailing edge portion 14*a* of the protective film 14, and the trailing edge of the lead tape 15*a* is bonded onto the leading edge portion 14*b* of the protective film 14.

The protective film 14 is attached to the surface of the photoreceptor layer 13 to protect the same against dust and light for prevention of degradation of the characteristics of the photoreceptor layer 13. The adhesive force between the trailing edge 15*a* of the lead tape 15 and the leading edge portion 14*b* of the protective film 14 is higher than the attaching forces between the leading edge portion 14*b* and the trailing edge portion 14*a* of the protective film 14 and between the protective film 14 and the photoreceptor layer 13. By these configurations, the protective film 14 can be removed together with the lead tape 15 by lifting the tip 15*b* of the extension 15 while moving the photoreceptor belt 10 in the clockwise direction as viewed in FIG. 1B.

Figure 3:
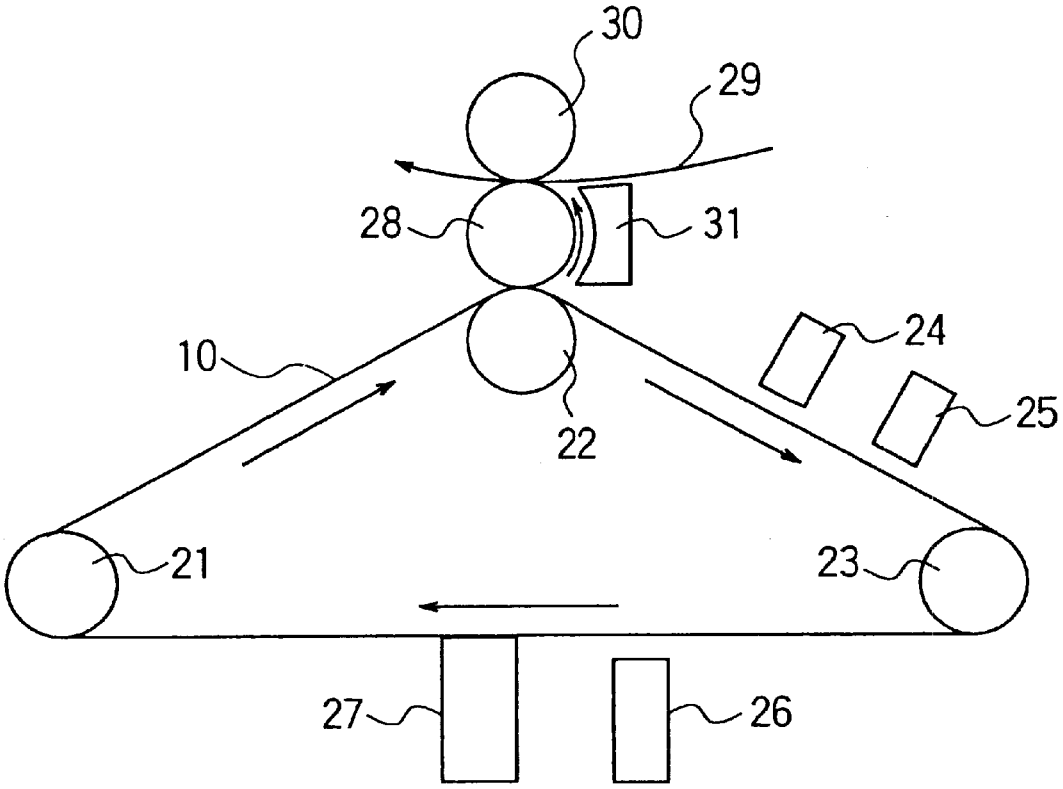
FIG. 3 is a side view of a recording device using the photoreceptor belt of the first embodiment.

Referring to FIG. 3, there is shown the photoreceptor belt 10 of the present embodiment installed in a recording device. The recording device comprises a set of belt rollers, including a belt drive roller 21 for driving the photoreceptor belt 10, a transfer guide roller 22 for assisting the transcription of the toner image to a transferring roller 28, a belt tension roller 23 for providing or removing a suitable tension to the photoreceptor belt 10, and a drive mechanism (not shown) for driving the belt rollers to move the photoreceptor belt 10 in the clockwise direction.

The recording device further comprises an erasing unit 24 for erasing all the remaining electric charge from the photoreceptor belt 10, a charge unit 25 for electrifying the photoreceptor belt 10 with uniform charge, an exposure unit 26 including a LED for exposing the photoreceptor belt 10 for forming a latent image on the photoreceptor belt 10 based on the image data supplied to the recording device, a development unit 27 for forming a toner image based on the latent image, a fixing roller 30 for fixing an image based on the image data onto a recording sheet 29 in association with the transferring roller 28 by using heat and pressure, and a lead tape guide 31 for guiding the lead tape 15 and the protective film 14 between the fixing roller 30 and the transferring roller 28 toward outside the recording device. The lead tape guide 31 has a concave surface opposed to the cylindrical surface of the transferring roller 28 and having an edge protruding from the outer surface of the transferring roller 28 toward the surface of the photoreceptor belt 10.

In operation of the recording device of FIG. 3, the belt drive roller 21 drives the photoreceptor belt 10, from which the protective film 14 is removed to expose the photoreceptor film 13, in the clockwise direction at a constant speed. The erasing unit 24 exposes the surface of the photoreceptor layer 13 to light to thereby remove the electric charge remaining on the photoreceptor layer 13. The charge unit 25 electrifies the photoreceptor layer 13 with uniform electric charge.

The exposure unit 26 then exposes the electrified portion of the photoreceptor layer 13 to generate a charge distribution profile based on the image data. The development unit 27 supplies toner onto the surface of the photoreceptor layer 13 to form a toner image based on the electric charge distribution profile. The toner image on the photoreceptor layer 13 is then transferred onto the transferring roller 28, and further transferred to the recording sheet 29 and fixed thereto while passing the recording sheet 29 between the transferring roller 28 and the fixing roller 30.

If the photoreceptor layer 13 is exhausted after iterated operations thereof, the photoreceptor belt 10 is replaced by a stored, new photoreceptor belt. Specifically, the exhausted photoreceptor belt 10 is removed from the set of rollers after effecting separation of the fixing roller 30 from the transferring roller 28, separation of the transferring guide roller 22 from the transferring roller 28, and shifting the belt tension roller 23 toward the drive roller 21 by the driving mechanism not shown to loose the photoreceptor belt 10. The new photoreceptor belt 10 is then installed in the recording device and provided with a suitable tension by setting the rollers in the operable position, with the development unit 17 being retracted from the photoreceptor belt 10 into an inoperable position.

The new photoreceptor belt 10 is then driven by the belt drive roller 21 for movement in the clockwise direction. When the lead tape 15 of the photoreceptor belt 10 reaches to one of the rollers 21, 22 and 23, the tip of the lead tape 15 rises from the direction parallel to the photoreceptor belt 10 to the direction of the tangent of the surface of the roller 21, 22 or 23, as shown in FIG. 1A, due to the sufficient stiffness of the lead tape 15. After the lead tape 15 passes by one of the rollers 21, 22 and 23, the tip 15*b* of the lead tape 15 falls toward the surface of the protective film 14 and maintains its posture parallel to the photoreceptor belt 10.

Figure 1B:
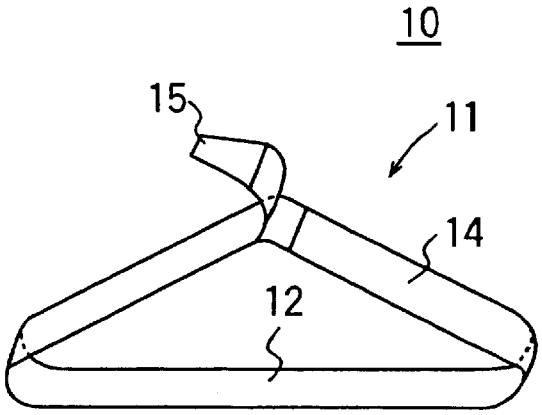

When the lead tape 15 reaches the transferring guide roller 22 in FIG. 3, the tip of the lead tape 15 rises from the protective film 14 and is further raised by the lead tape guide 31 and guided thereby to pass between the transferring roller 28 and the fixing roller 30. As a result, the lead tape 15 and the following protective film 14 is guided between the transferring roller 28 and the fixing roller 30 and removed from the photoreceptor belt 10, as shown in FIG. 1B. The protective film 14 thus removed is discharged from the recording device similarly to a recording sheet 29 to leave the photoreceptor belt 10 installed in the recording device, with the photoreceptor layer 13 being exposed. After the removal of the protective film 14 from the photoreceptor belt 10, the development unit 27 is shifted into an operable position thereof.

According to the present embodiment, the extension or lead tape 15, having a higher stiffness than the photoreceptor belt 10 and having a trailing edge 15*a* bonded to the bonded end portions 14*a* and 14*b* of the protective film 14 with a higher adhesive force than the bonded end portions 14*a* and 14*b* of the protective film 14, enables the lead tape 15 and the protective film 14 to be removed from the photoreceptor belt 10 without any assisting operation by the operator. As a result, the photoreceptor layer 13 is free from a damage such as scratch or optical fatigue, even without an expensive cartridge.

Figure 4:
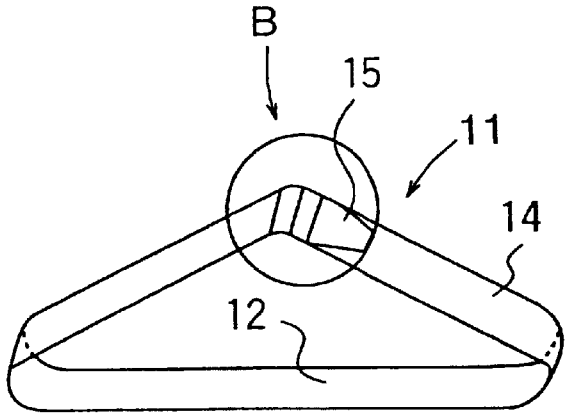
FIG. 4 is a perspective view of a photoreceptor belt according to a second embodiment of the present invention.
Figure 5:
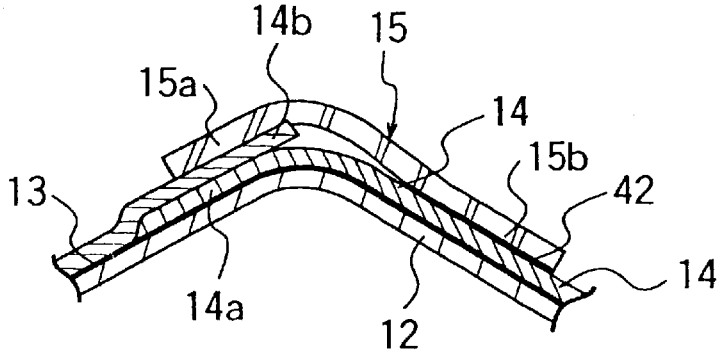
FIG. 5 is a cross-sectional view of a portion "B" of the photoreceptor belt of the second embodiment.

FIG. 4 shows a photoreceptor belt according to a second embodiment of the present invention similarly to FIG. 1A, and FIG. 5 shows a cross-section of a portion "B" of the photoreceptor belt shown in FIG. 4. The photoreceptor belt 10 of the present embodiment is similar to the photoreceptor belt of the first embodiment except that the tip 15*b* of the lead tape 15 is bonded onto the protective film 14 by using a thermo-fusing adhesive 42, as shown in FIG. 5. The term "thermo-fusing adhesive" as used herein means an adhesive which has a sufficient adhesiveness below a specified temperature range and fuses above the specified temperature range to have little adhesiveness.

Figure 6:
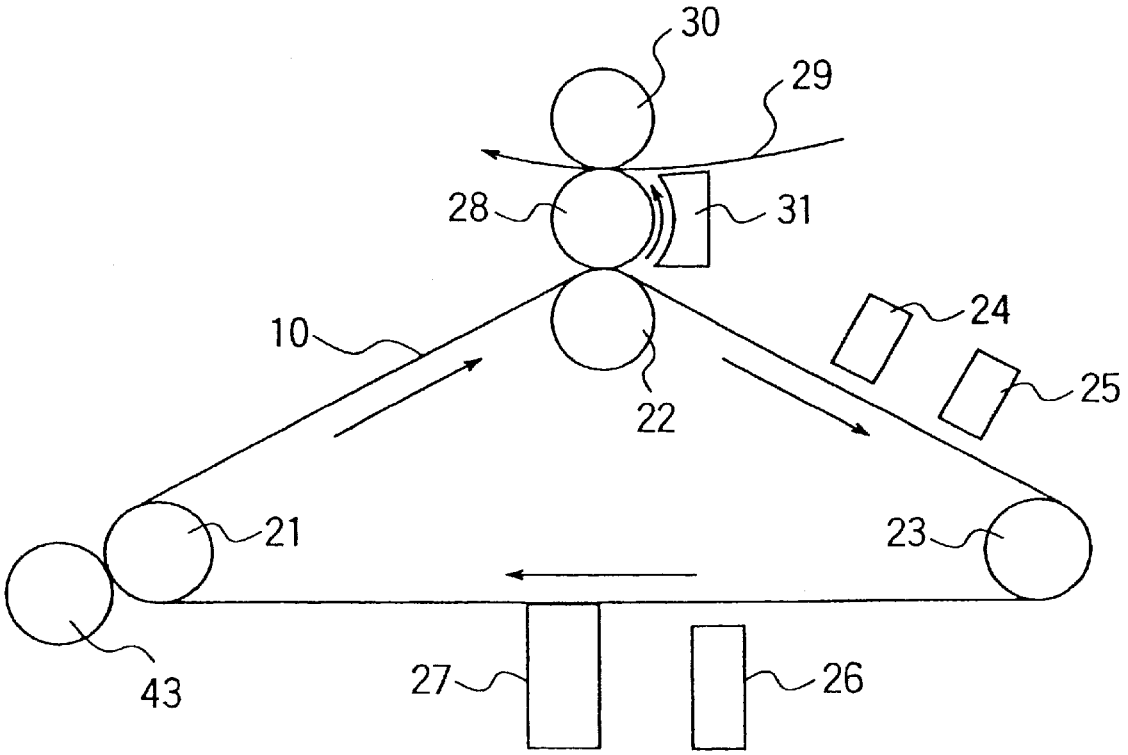
FIG. 6 is a side view of a recording device using the photoreceptor belt of the second embodiment.

FIG. 6 shows the photoreceptor belt of FIG. 4 installed in a recording device. The recording device of FIG. 6 is similar to the recording device of FIG. 3 except that a heat roller 43 is disposed in association with a belt drive roller 21 to sandwich the photoreceptor belt 10, thereby heating and fusing the adhesive 42 provided between the tip 15*b* of the lead tape 15 and the protective film 14 in the present embodiment.

In operation of the recording device of FIG. 4 in the first embodiment, when a new photoreceptor belt 10 is installed in the recording device, the free tip 15*b* of the lead tape 15 rises at each roller 21, 22 or 23, as mentioned above. In order to assure the guide of the tip 15*b* of the lead tape 15 by the lead tape guide 31 in the first embodiment, the development unit 27 should be retracted into the inoperable position thereof for assuring the space for safely passing the tip 15*b* of the lead tape 15. On the other hand, in the present embodiment, the tip 15*b* of the lead tape 15 is adhered to the protective film 14 before passing by the heat roller 43, as a result of which the development unit 27 need not be retracted into the inoperable position thereof. The tip 15*b* of the lead tape 15 is rendered free after the tip passes by the heat roller 43, rises at the transferring guide roller 22, and is guided by the lead tape guide 31 for removing the lead tape 15 together with the protective film 14.

Since the above embodiments are described only for examples, the present invention is not limited to the above embodiments and various modifications or alterations can be easily made therefrom by those skilled in the art without departing from the scope of the present invention.

For example, the lead tape guide 31 may be disposed in association with one of other rollers 21 and 23 and an additional roller in place of the combination of the transferring guide roller 22 and transferring roller 28.

In addition, the extension 15 may be formed integral with the protective film so long as the extension 15 has a higher stiffness than the body of the protective film 14 and the endless belt base 12.

What is claimed is:

1. A photoreceptor belt comprising an endless belt, a photoreceptor layer formed on an outer surface of said endless belt, and a protective film covering said photoreceptor layer and having a leading edge portion overlying a trailing edge portion and attached thereto, and an extension extending from said leading edge portion of said protective film, said extension having a higher stiffness than said protective film.

2. A photoreceptor belt as defined in claim 1, wherein said extension is a lead tape having a trailing edge attached to said leading edge portion of said protective film.

3. A photoreceptor belt as defined in claim 1, wherein said extension has a free leading edge.

4. A photoreceptor belt as defined in claim 1, wherein said extension has a leading edge bonded onto the surface of said protective film by using a thermo-fusing adhesive.

5. A photoreceptor belt as defined in claim 1, wherein said extension has a stiffness higher than a stiffness of said endless belt.

6. A photoreceptor belt as defined in claim 1, wherein an adhesive force between said trailing edge of said extension and said leading edge portion of said protective film is higher than an attaching force between said trailing edge portion and said leading edge portion of said protective tape.

7. A recording device comprising a set of rollers for driving a photoreceptor belt having a photoreceptor layer and a protective film covering said photoreceptor layer and having an extension, a charge unit for electrifying said photoreceptor layer, an exposure unit for exposing said photoreceptor layer for generating a charge distribution profile, a development unit for developing said photoreceptor layer to have a toner image, a transfer unit for transferring the toner image onto a recording medium, a lead tape guide, disposed in association with one of said rollers, for guiding a tip of said extension to remove said extension and said protective film from said photoreceptor layer.

8. A recording device as defined in claim 7, further comprising a heat roller for thermally diffusing an adhesive between said tip of said extension and said protective film before said removal of said extension and said protective film.

9. A recording device as defined in claim 7, wherein said one of rollers is a transferring guide roller of said transfer unit.

* * * * *